United States Patent [19]

Fender

[11] 4,319,510

[45] Mar. 16, 1982

[54] SPLITTER SWITCH FOR HUMBUCKING MUSICAL INSTRUMENT PICK-UPS

[76] Inventor: C. Leo Fender, 2851 Rolling Hills Dr. Sp. 33, Fullerton, Calif. 92635

[21] Appl. No.: 146,662

[22] Filed: May 5, 1980

[51] Int. Cl.[3] ..... G10H 3/00

[52] U.S. Cl. ..... 84/1.15; 84/1.16

[58] Field of Search ..... 84/1.15, 1.16, 1.14

[56] References Cited

U.S. PATENT DOCUMENTS

| | | | |
|---|---|---|---|
| 2,897,709 | 8/1959 | McCarty et al. | 84/1.15 |
| 3,472,943 | 10/1969 | Kawabata et al. | 84/1.15 |
| 3,915,048 | 10/1975 | Stich | 84/1.15 |
| 4,164,163 | 8/1979 | Rhodes | 84/1.15 |
| 4,222,301 | 9/1980 | Valdez | 84/1.15 |

*Primary Examiner*—J. V. Truhe

*Assistant Examiner*—Forester W. Isen

*Attorney, Agent, or Firm*—Philip M. Hinderstein

[57] ABSTRACT

In a pick-up for an electrical musical instrument of the type including first and second pick-up assemblies positioned in parallel, spaced relationship, each of the pick-up assemblies including at least one pole piece operatively associated with the strings of the instrument and a coil wound around the pole pieces, there is disclosed an improved splitter switch whereby whether the coils are connected in series or in parallel, when single coil operation is desired, the coils are connected in series with a capacitor across one of the coils whereby the splitter switch effectively provides single coil operation without decreasing the overall signal level of the pick-up.

6 Claims, 6 Drawing Figures

SPLITTER SWITCH FOR HUMBUCKING MUSICAL INSTRUMENT PICK-UPS

BACKGROUND OF THE INVENTION

1. Field of the Invention

The present invention relates to a splitter switch for humbucking musical instrument pick-ups and, more particularly, to a splitter switch arrangement for a pick-up, used in conjunction with a capacitor, whereby switching from a humbucking arrangement to a single coil arrangement can be effected without decreasing the overall signal level of the pick-ups.

2. Description of the Prior Art

The present invention relates broadly to electrical musical instruments of the stringed type. It is particularly applicable to an electric guitar or a similar musical instrument having a plurality of stretched strings extending across a body and a neck, between the head of the instrument and a bridge assembly connected to the body, in which the strings are caused to vibrate by plucking or picking same.

In order to derive an output from such an electrical guitar or other similar electrical musical instrument, the instrument is conventionally provided with an electromagnetic pick-up comprising a number of magnetic elements (pole pieces) having wound therearound a conductive coil. Typically, one such magnetic element is disposed directly beneath each string of the instrument. The strings are constructed of a magnetizable substance, such as steel, and, therefore, become part of the conductive path for the magnetic lines of flux of the pole pieces. Accordingly, when any of the strings are caused to vibrate, this causes a disturbance in the magnetic field of the associated pole piece. This has the effect of generating a voltage in the conductive coil, which voltage may be suitably amplified and transmitted to a loudspeaker system.

With such an electromagnetic pick-up construction, a number of problems exist. Electric guitars and other similar electrical musical instruments are used in areas having strong magnetic fields from lighting fixtures, motors, transformers and the like, and these magnetic fields are sensed by the pickup as an extraneous noise source. In the United States, such source typically has a frequency of 60 Hz, the usual power line frequency. These magnetic fields induce voltages in the coil which also are amplified and transmitted to the loudspeaker system, manifesting themselves in an objectionable hum.

In order to overcome this problem, it is known to provide a pick-up for an electrical musical instrument including a pair of identical pick-up assemblies, each having a plurality of magnetic pole pieces and a coil, the pick-up assemblies being positionable in parallel, spaced, closely adjacent relationship. All of the pole pieces of one of the pick-up assemblies have their north poles adjacent to the strings and their south poles relatively remote from the strings, whereas all of the pole pieces of the other pick-up assembly have their south poles adjacent to the strings and their north poles relatively remote from the strings. The coils of the two pick-up assemblies are wound in opposite directions and the two coils are connected either in series or in parallel. Because the direction of current flow in each coil is governed by the magnetic polarity, the direction of current flow in one coil is opposite to that of the other coil for each string. However, since the directions of the windings of the two coils are opposite, the signal induced in each coil as a result of string vibrations is additive and the output signal is the sum of the signals induced in each coil. If the coils are connected in series, the output signal is the sum of the voltages induced across each coil. If the coils are connected in parallel, the output signal is the sum of the currents induced in each coil.

On the other hand, signals picked up by the coils from power line sources produce currents in the coils which are independent of the magnetic polarity and, accordingly, such power line sources produce voltages that are in phase. However, since the coils are wound in opposite directions, these in-phase signals cancel and the output signal is the difference between the power line signals induced in each coil. This means that any noise from power line sources which is otherwise manifested as an objectionable hum, is effectively reduced or cancelled. It is for this reason that such an arrangement is typically characterized as a humbucking arrangement.

While humbucking pick-ups have come into common use in electric guitars and other similar electrical musical instruments, there are problems associated therewith. For example, since the pick-ups have different positions along the length of the strings, they respond differently to the harmonics of the string vibrations. This fact, as well as others which result from the interaction between the coils, results in a pick-up in which the two coils together do not provide as clean and as sharp a response, especially at high frequencies, as is the case with a single coil.

Therefore, it has become common practice with some instrument makers to provide a switch, commonly referred to as a splitter switch, which allows the musician the option of short circuiting one coil of the humbucking pair. When this is done, the remaining active coil clearly has a cleaner and better response to high notes and this is much preferred by many musicians. On the other hand, when the splitter switch is closed to short circuit one of the coils, the output signal is effectively cut in half. That is, in a series connection, the voltage output is immediately cut in half, whereas with parallel coils, the current output is immediately cut in half. Since the overall signal level is cut in half, closing of the splitter switch immediately and significantly reduces the volume output of the loudspeaker system. Most musicians find this to be a considerable nuisance because movement of the splitter switch requires immediate readjustment of the volume level.

SUMMARY OF THE INVENTION

According to the present invention, there is provided a splitter switch for humbucking musical instrument pick-ups which does not result in a decrease in volume when switching from a humbucking arrangement to a single coil arrangement. This is achieved by connecting a capacitor across one of the coils rather than completely short circuiting same, the value of the capacitor being selected to short circuit all frequencies other than the lowest frequencies in the audio range, such as frequencies lower than 100 Hz. The result is that a voltage level is still maintained across the one coil and the high frequency signal of the other coil is superimposed on this voltage, thereby giving an increased volume level even for the high frequencies. The result is that there is no noticeable decrease in volume when the splitter switch is closed, even though there is a significant change in the sound from the humbucking pair, similar to the sound obtained from a single coil.

Briefly, where the coils of a pick-up assembly are connected in series, the splitter switch is connected in series with a capacitor across one of the coils so that closing of the switch merely couples such capacitor across the one coil. Where the coils are connected in parallel, a three-way switch is provided whereby in one position thereof, the coils are connected in parallel, whereby in a second position thereof, the coils are connected in series and one of the coils is short circuited, and whereby in a third position thereof, the coils are connected in series with the capacitor connected across one of the coils.

OBJECTS, FEATURES AND ADVANTAGES

It is therefore an object of the present invention to solve the problems associated with splitter switches for use with humbucking musical instrument pick-ups. It is a feature of the present invention to solve these problems by using a capacitor in conjunction with the splitter switch. An advantage to be derived is that there is no decrease in volume when the splitter switch is closed.

Still other objects, features and attendant advantages of the present invention will become apparent to those skilled in the art from a reading of the following detailed description of the preferred embodiments constructed in accordance therewith, taken in conjunction with the accompanying drawings wherein like numerals designate like parts in the several figures and wherein:

DESCRIPTION OF THE PREFERRED EMBODIMENTS

Figure 1:
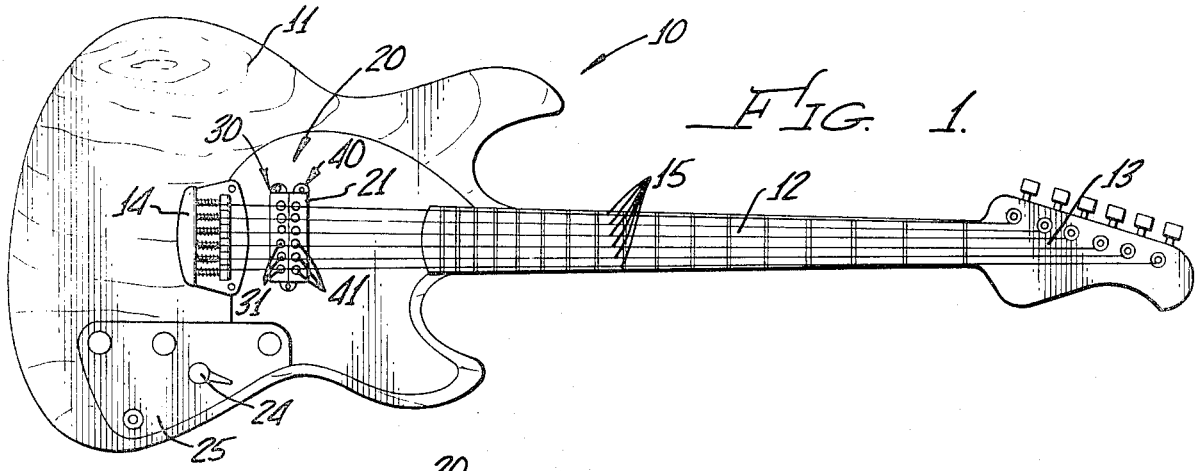
FIG. 1 is a top plan view of an electrical guitar incorporating the present invention.

Referring now to the drawings and, more particularly, to FIG. 1 thereof, the present invention is illustrated as being incorporated in an electric guitar, generally designated 10, including a body 11, a fretted neck 12, and a head 13 being connected to one end of neck 12, the other end of neck 12 being connected to body 11. Tensioned between head 13 of guitar 10 and a bridge assembly 14 connected to body 11 are a plurality of strings 15 which lie generally in a single plane parallel to the face of body 11. Strings 15 are constructed of a magnetizable substance, such as steel, and are graduated in diameter in a conventional manner.

In order to derive an output from guitar 10, it is provided with at least one electromagnetic pick-up, generally designated 20, of a configuration which is generally known in the art. Vibrations of strings 15, as a result of plucking or picking same, produce an electrical signal in pick-up 20, which signal may be suitably amplified and transmitted to a loudspeaker system.

Pick-up 20 has a general configuration which is known in the prior art. Specifically, in order to provide humbucking, pick-up 20 includes at least first and second pick-up assemblies 30 and 40, pick-up assembly 30 comprising a plurality of identical magnetic elements (pole pieces) 31, which may be magnetized in any one of several ways known to those skilled in the art, and pick-up assembly 40 comprising a similar plurality of identical magnetic elements (pole pieces) 41. The number of pole pieces 31 and 41 are preferably identical and preferably the same as the number of strings 15. In any event, pole pieces 31 and 41 are mounted in body 11 in parallel, closely spaced relationship and held in position by a suitable cap 21.

Figure 2:
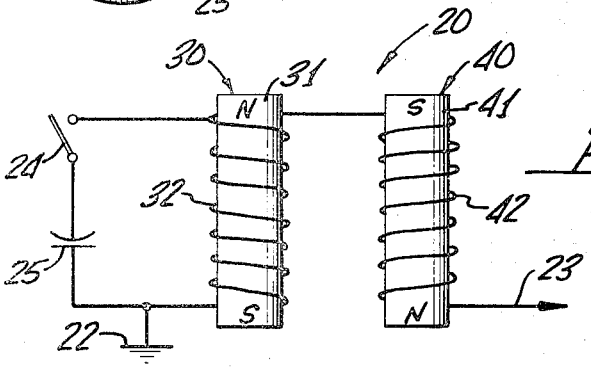
FIG. 2 is a schematic representation of the pick-up of the guitar of FIG. 1 and showing a first embodiment of the present invention.

With reference also to FIG. 2, it is noted that in order to provide a humbucking arrangement, all of pole pieces 31 of pick-up assembly 30 have their north poles adjacent to strings 15 and their south poles relatively remote from strings 15, whereas all of pole pieces 41 of pick-up assembly 40 have their south poles adjacent to strings 15 and their north poles relatively remote from strings 15. This arrangement may be reversed.

A coil 32 formed from a large number of turns of fine conductive wire is wound around pole pieces 31 of pick-up assembly 30, whereas a coil 42 formed from a large number of turns of fine conductive wire is wound around pole pieces 41 of pick-up assembly 40. The wire in coils 32 and 42 is insulated, such as with varnish or lacquer, and the entire assembly comprising the pole pieces, the supporting plates and the coils are preferably dipped in a suitable varnish or lacquer. As is known in the art, movement of strings 15, as in the strumming or playing of guitar 10, results in voltages being induced across coils 32 and 42. These voltages are transferred to the input circuit of an amplifier and a loudspeaker system.

In order to provide a humbucking arrangement, coils 32 and 42 are wound in opposite directions. According to the embodiment of FIG. 2, coils 32 and 42 are connected in series between ground 22 and an output lead 23. Because the direction of current flow in each coil is governed by the magnetic polarity, the direction of current flow in each coil is opposite to that of the other coil for each string. However, since the direction of winding of the two coils is opposite, the voltages induced in the coils as a result of string vibrations are additive and the signal output on lead 23 is the sum of the voltages induced in each coil.

On the other hand, signals picked up by coils 32 and 42 from the power line service produce currents in coils 32 and 42 which are independent of the magnetic polarity and, accordingly, such extraneous signals produce voltages that are in phase. However, since coils 32 and 42 are wound in opposite directions, these in-phase signals cancel and the signal output on lead 23 is the difference between the extraneous signal voltages induced in each of coils 32 and 42. This means that any noise from power line sources, which is otherwise manifested as an objectionable hum, is effectively reduced or cancelled. It is for this reason that the arrangement may be characterized as a humbucking arrangement.

As mentioned previously, while humbucking pick-ups, such as pick-up 20, have come into common use in electric guitars and other similar musical instruments, there are problems associated therewith. For example, since pick-ups 30 and 40 have different positions along the length of strings 15, they respond differently to the harmonics of the string vibrations. This fact, as well as others which result from the interaction between coils 32 and 42, results in a pick-up in which coils 32 and 42 together do not provide as clean and as sharp a response, especially at high frequencies, as is the case with a single coil.

Therefore, it has become common practice with some instrument makers to provide a switch, such as a switch 24 mounted on a control panel 25 with other switches and volume controls (not shown), which allows the musician the option of short circuiting one coil, such as coil 32, of the humbucking pair. When this is done, the remaining active coil 42 clearly has a cleaner and better response to high notes and this is much preferred by many musicians. However, since the signal output on lead 23 is the sum of the voltages induced in coils 32 and 42, it is obvious that closing of switch 24 and short circuiting of coil 32 immediately cuts the voltage on output lead 23 in half. This is highly objectionable.

According to the present invention, switch 24 is connected in a series circuit with a capacitor 25, switch 24 and capacitor 25 being connected across coil 32. The value of capacitor 25 is selected to provide a shunt for frequencies other than very low frequencies in the audio range. For example, the value of capacitor 25 may be selected so that it is virtually an open circuit for all frequencies below 100 Hz, with capacitor 25 progressively acting as a short circuit as frequencies increase above 100 Hz.

The effect of including capacitor 25 in series with splitter switch 24 across coil 32 should be apparent. With switch 24 open, coils 32 and 42 are connected in series and the output signal on lead 23 is the sum of the voltages induced in coils 32 and 42. When switch 24 is closed, because capacitor 25 functions as an open circuit at low audio frequencies, there is no change in the output voltage on lead 23 for the low frequencies. While capacitor 25 effectively short circuits coil 32 for high frequencies, the high frequency output of coil 42 is effectively superimposed on the combined low frequency outputs of coils 32 and 42 so that when switch 24 is closed, there is no noticeable decrease in the volume from the amplification system responsive to the output signal on line 23.

On the other hand, since coil 32 is effectively short circuited for high frequencies, closing of switch 24 provides pick-up 20 with a cleaner and better response to high notes, which is the preferred sound by musicians. Accordingly, a musician can switch from a humbucking arrangement to a single coil arrangement without the necessity of changing the volume controls on the instrument.

Some musicians prefer having coils 32 and 42 connected in parallel. In the absence of a splitter switch, if coils 32 and 42 were connected in parallel, the humbucking effect would be identical to that described previously. However, if coils 32 and 42 were to be connected in parallel, the use of a splitter switch is not quite as simple because short circuiting one coil would effectively short circuit both. Furthermore, connecting a capacitor in parallel with one coil would connect the capacitor in parallel with both. This problem is solved with the present invention.

Figure 3:
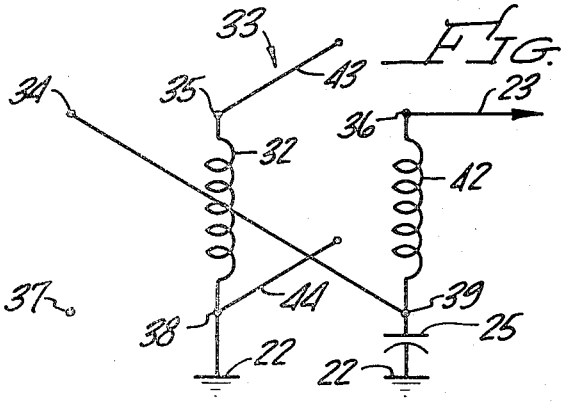
FIG. 3 is a schematic representation of the pick-up of the guitar of FIG. 1 and showing a second embodiment of the present invention.

More specifically, and with reference to FIG. 3, there is shown a splitter switch arrangement, generally designated 33, for connecting coils 32 and 42 in parallel between ground 22 and output lead 23. More specifically, splitter switch 33 is a double pole, double throw switch having terminals 34–39 and moveable arms 43 and 44. Coil 32 is connected between terminals 35 and 38 whereas coil 42 is connected between terminals 36 and 39. Terminal 38 is connected to ground 22, whereas terminal 39 is connected via capacitor 25 to ground 22. Terminals 34 and 39 are connected together and terminal 36 is connected to lead 23. Arm 43 is connected to terminal 35 and may be moved into contact with terminal 34 or 36. Arm 44 is connected to terminal 38 and may be moved into contact with terminal 37 or 39.

Splitter switch 33 is a three-position switch wherein in a first position, arms 43 and 44 are in contact with terminals 36 and 39, respectively, in a second position, arms 43 and 44 are in contact with terminals 34 and 39, respectively, and in a third position, arms 43 and 44 are in contact with terminals 34 and 37, respectively. The effect of these three positions is shown in FIGS. 4, 5 and 6, respectively.

Figure 4:
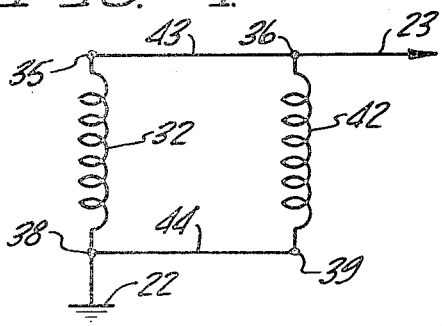

More specifically, and with reference to FIGS. 3 and 4, it is seen that with arms 43 and 44 in contact with terminals 36 and 39, respectively, coils 32 and 42 are connected in parallel between ground 22 and output lead 23. Capacitor 25 is short circuited by the connection from terminal 39 to ground via arm 44 and terminal 38.

Figure 5:
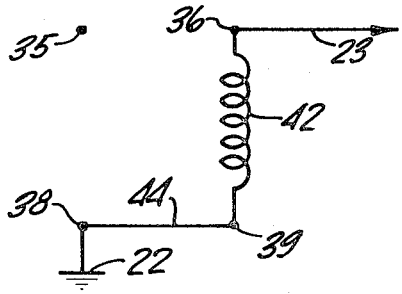
FIGS. 4–6 are simplified representations of the different electrical connections possible with the splitter switch arrangement shown in FIG. 3.

With reference to FIGS. 3 and 5, it is seen that with arms 43 and 44 in contact with terminals 34 and 39, respectively, capacitor 25 remains short circuited and the opposite ends of coil 32 are connected together because of the connection between terminals 34 and 39. The end result is that coil 42 alone is connected between ground 22 and output lead 23. Thus, the musician is provided with the options he had previously, namely coils 32 and 42 in parallel or a single coil 42.

Figure 6:
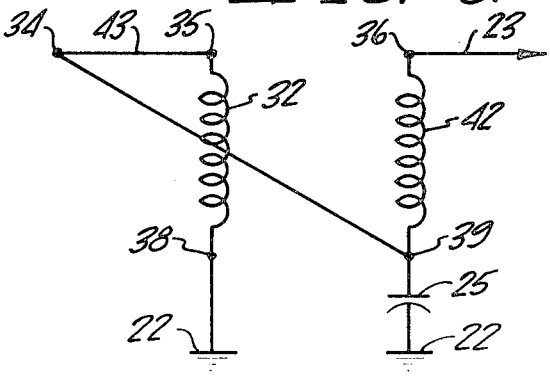

With reference to FIGS. 3 and 6, it is seen that with arms 43 and 44 in contact with terminals 34 and 37, respectively, the musician is provided with an additional option. That is, in this position, coil 32 is no longer in parallel with coil 42, but is placed in parallel with capacitor 25 and this parallel combination is connected in series between ground 22 and coil 42. This is the same configuration discussed previously with regard to the embodiment of FIG. 2 with switch 24 closed and the result is the same.

It can therefore be seen that according to the present invention, there is provided a splitter switch for humbucking musical instrument pick-ups which does not result in a decrease in volume when switching from a humbucking arrangement to a single coil arrangement. This is achieved by connecting a capacitor across one of the coils, rather than completely short circuiting same, the value of the capacitor being selected to short circuit all frequencies other than the lowest frequencies in the audio range, such as frequencies lower than 100 Hz. The result is that a voltage level is still maintained across the one coil and the high frequency signal of the other coil is superimposed on this voltage, thereby giving an increased volume level even for the high frequencies. The result is that there is no noticeable decrease in volume when the splitter switch is closed, even though there is a significant change in the sound from the humbucking pair, similar to the sound obtained from a single coil.

While the invention has been described with respect to the preferred physical embodiments constructed in accordance therewith, it will be apparent to those skilled in the art that various modifications and improvements may be made without departing from the scope and spirit of the invention. Accordingly, it is to be understood that the invention is not to be limited by the specific illustrative embodiments, but only by the scope of the appended claims.

I claim:

1. In a pick-up for an electrical instrument of the type including first and second pick-up assemblies positioned in parallel, spaced relationship, each of said pick-up assemblies including at least one pole piece operatively associated with the strings of said instrument and a coil wound around said pole piece, the improvement comprising:

a capacitor, the value of said capacitor being selected to provide, when connected across one of said coils, a shunt for frequencies other than low frequencies in the audio frequency range; and a switch interconnecting said coils and said capacitor, said switch being operative, in a first position thereof, to connect said coils in parallel with said capacitor unconnected, and, in a second position thereof, to connect said coils in series with said capacitor connected in parallel with only one of said coils.

2. In a pick-up according to claim 1, wherein said switch, in said first position thereof, short circuits said capacitor.

3. In a pick-up according to claim 1, wherein said switch, in a third position thereof, short circuits one of said coils and said capacitor.

4. In a pick-up according to claim 1 or 3, wherein said pick-up assemblies are connected in a humbucking configuration.

5. In a pick-up according to claim 4, wherein said capacitor functions as a virtual open circuit for frequencies below approximately 100 Hz.

6. In a pick-up according to claim 1 or 3, wherein said capacitor functions as a virtual open circuit for frequencies below approximately 100 Hz.

* * * * *